US010005104B2

(12) United States Patent
Yoshida et al.

(10) Patent No.: US 10,005,104 B2
(45) Date of Patent: Jun. 26, 2018

(54) BLACK COATING FILM-FORMING VEHICLE COMPONENT AND/OR FASTENING COMPONENT, AND MANUFACTURING METHOD THEREOF

(71) Applicant: Honda Motor Co., Ltd., Tokyo (JP)

(72) Inventors: Hiroyuki Yoshida, Saitama (JP); Shinsuke Mochizuki, Saitama (JP); Hiroshi Hirayama, Saitama (JP); Toshiyasu Nagai, Saitama (JP); Yasutake Nemichi, Kanagawa (JP); Daisuke Sadohara, Kanagawa (JP); Katsumi Shimoda, Kanagawa (JP); Kenichi Nishikawa, Kanagawa (JP)

(73) Assignee: HONDA MOTOR CO., LTD., Minato-Ku, Tokyo (JP)

( * ) Notice: Subject to any disclaimer, the term of this patent is extended or adjusted under 35 U.S.C. 154(b) by 305 days.

(21) Appl. No.: 14/915,360

(22) PCT Filed: Aug. 28, 2013

(86) PCT No.: PCT/JP2013/072956
§ 371 (c)(1),
(2) Date: Feb. 29, 2016

(87) PCT Pub. No.: WO2015/029156
PCT Pub. Date: Mar. 5, 2015

(65) Prior Publication Data
US 2016/0214139 A1 Jul. 28, 2016

(51) Int. Cl.

| | |
|---|---|
| ***B05D 5/06*** | (2006.01) |
| ***B05D 5/00*** | (2006.01) |
| ***B05D 7/14*** | (2006.01) |
| ***C23C 22/83*** | (2006.01) |
| ***C23C 28/00*** | (2006.01) |
| ***C23C 22/00*** | (2006.01) |
| *B05D 3/02* | (2006.01) |

(52) U.S. Cl.
CPC ..... *B05D 5/00* (2013.01); *B05D 5/06* (2013.01); *B05D 7/14* (2013.01); *C23C 22/00* (2013.01); *C23C 22/83* (2013.01); *C23C 28/3225* (2013.01); *C23C 28/345* (2013.01); *B05D 3/0254* (2013.01); *C23C 2222/10* (2013.01)

(58) Field of Classification Search
None
See application file for complete search history.

(56) References Cited

U.S. PATENT DOCUMENTS 4,359,348 A * 11/1982 Crotty ..... C23C 22/53 148/250
4,411,964 A * 10/1983 Hara ..... C09D 5/08 428/623
4,659,394 A * 4/1987 Hara ..... C09D 5/08 148/251
4,889,775 A * 12/1989 Adaniya ..... C08G 18/643 428/623
4,891,273 A * 1/1990 Odashima ..... B32B 15/08 428/623
4,970,126 A * 11/1990 Adaniya ..... B05D 7/51 428/623
5,023,146 A * 6/1991 Saito ..... C23C 22/78 428/623
5,061,575 A * 10/1991 Mohri ..... B05D 7/51 428/623
5,110,689 A * 5/1992 Watanabe ..... B05D 7/16 428/623
5,387,473 A * 2/1995 Yoshimi ..... B05D 7/14 428/623
5,478,655 A * 12/1995 Sabata ..... B05D 7/51 428/469
5,496,652 A * 3/1996 Sasaki ..... B05D 7/51 428/623
5,641,578 A * 6/1997 Yoshimi ..... C23C 28/00 428/623
6,180,177 B1 * 1/2001 Nagashima ..... C08G 8/12 427/388.4
6,605,683 B1 * 8/2003 Zhang ..... C08G 77/045 428/447
6,663,700 B1 * 12/2003 Matzdorf ..... C09D 5/084 106/14.21
7,029,541 B2 * 4/2006 Diaddario, Jr. ..... C23C 22/34 106/14.05

(Continued)

FOREIGN PATENT DOCUMENTS

| | | |
|---|---|---|
| CN | 101426590 A | 5/2009 |
| EP | 1484432 | 8/2004 |
| JP | H07-37107 B2 | 4/1995 |
| JP | 07186322 A | 7/1995 |
| JP | 3584937 B1 | 11/2004 |
| JP | 2005194553 A | 7/2005 |
| JP | 2008069336 A | 3/2008 |
| JP | 2012135740 A | 7/2012 |

*Primary Examiner* — Robert S Loewe

(74) *Attorney, Agent, or Firm* — Browdy and Neimark, PLLC

(57) ABSTRACT

An object is to provide a technique capable of forming a film having a dark black appearance and high corrosion resistance on a zinc plated component in a simple process, and a black coating film-forming vehicle component and/or fastening component that is obtained by: treating a surface of a zinc plated metal substrate with a black chemical conversion treatment agent containing trivalent chromium as an active ingredient, to form a black chemical conversion treatment film having an L value (brightness) of from 33 to 30; coating a black coating composition containing a black pigment in an amount of from 25 to 65% by weight in a thermosetting film-forming component and an alkoxysilane oligomer, on the black chemical conversion treatment film; and heat-curing the black coating composition thus coated.

13 Claims, No Drawings

(56) References Cited

U.S. PATENT DOCUMENTS 7,083,831 B1 * 8/2006 Koch ..... C07F 7/006 427/487
7,314,671 B1 * 1/2008 Preikschat ..... C23C 22/34 428/472.1
7,541,095 B2 * 6/2009 Wu ..... C23C 28/00 428/446
7,691,498 B2 * 4/2010 Kendig ..... C23F 11/187 106/14.44
8,262,811 B2 * 9/2012 Capper ..... C23C 22/17 106/14.05
2004/0022950 A1 * 2/2004 Jung ..... C09D 5/002 427/385.5
2005/0109426 A1 * 5/2005 Inoue ..... C23C 22/17 148/258
2007/0196632 A1 8/2007 Meyer, Jr. et al.
2008/0210341 A1 * 9/2008 Yamamoto ..... C23C 22/17 148/267
2009/0020185 A1 * 1/2009 Inoue ..... C23C 22/30 148/250
2009/0050238 A1 * 2/2009 Inoue ..... C23C 22/47 148/22
2010/0168308 A1 * 7/2010 Miyahara ..... C09D 5/18 524/413
2011/0100513 A1 * 5/2011 Schlosser ..... C23C 22/34 148/267
2011/0155286 A1 * 6/2011 Sugiura ..... C23C 22/53 148/250
2011/0201727 A1 * 8/2011 Hashemzadeh ..... C04B 24/42 524/3
2013/0084453 A1 * 4/2013 Imokawa ..... C09D 5/084 428/341
2013/0171468 A1 * 7/2013 Imokawa ..... C09D 5/086 428/626
2013/0273389 A1 * 10/2013 Kaneko ..... C09D 5/084 428/626
2015/0037563 A1 * 2/2015 Bockmeyer ..... C03C 1/008 428/312.8

* cited by examiner

BLACK COATING FILM-FORMING VEHICLE COMPONENT AND/OR FASTENING COMPONENT, AND MANUFACTURING METHOD THEREOF

TECHNICAL FIELD

The present invention relates to a black coating film-forming vehicle component and/or fastening component, and more specifically relates to a black coating film-forming vehicle component and/or fastening component having high corrosion resistance and a dark black appearance that has a zinc plated film subjected to a trivalent chromate treatment and a treatment with a coating film forming resin containing a black pigment.

BACKGROUND ART

A zinc plated vehicle component or fastening component, such as a bolt, has been enhanced in appearance and corrosion resistance by subjecting to a chromate treatment with a chemical conversion treatment solution containing hexavalent chromium, but according to the tightening of the environmental regulation in recent years, the chemical conversion treatment solution is being transferred to one containing trivalent chromium as a major component. This movement reaches not only the ordinary chromate treatment but also a chemical conversion treatment that is referred to as black chromate with a black appearance, and development and utilization of a chemical conversion product containing trivalent chromium as a major component have been made.

However, black chromate using a chemical conversion treatment solution using trivalent chromium has a problem that desirable corrosion resistance capability and appearance (color tone) may not be obtained, as compared to a chemical conversion treatment using hexavalent chromium, and a solution therefor is demanded. For example, in the black chromate treatment with trivalent chromium, according to the amount of sulfur contained in the chemical conversion film, there is a tendency that the appearance is changed from dark green to greenish black, but the corrosion resistance is rather deteriorated. Furthermore, the final appearance reaches at most black with greenish tone remaining (L value (brightness) of approximately 30), but cannot reach dark black (L value (brightness) of 28 or less), which is achieved by black chromate by hexavalent chromium.

Under the circumstances, in the case where a high antirust treatment is required, it is necessary to use a finishing treatment, such as a top coating, but for retaining the corrosion resistance of the black chromate chemical conversion film as the underlayer, the blackness degree of the finish top coating is necessarily increased for imparting dark black color to the final product since highly dark black color may not be expected by the black chromate chemical conversion film.

However, for retaining the physical property of the film, the coating film-forming composition used in the ordinary top coating cannot contain a large amount of a black pigment, and therefore the top coating treatment is necessarily performed plural times for providing the intended black color, resulting in complication of the process and increase of the cost.

CITATION LIST

Patent Literature

PTL 1: JP-A-2008-69336

SUMMARY OF INVENTION

Technical Problem

Accordingly, there is a demand for development of a technique capable of forming a film having a dark black appearance and high corrosion resistance on a zinc plated component in a simple process, and it is a problem of the invention to provide a solution therefor.

Solution to Problem

Based on the knowledge that the density of black color and the corrosion resistance of a zinc plated component having been subjected to a black chromate treatment are contradictory to each other, the present inventors have made earnest investigations for achieving both corrosion resistance and a dark black appearance by forming a top coating with a coating film-forming resin containing a large amount of a black pigment on a black chromate-treated zinc plated component having some corrosion resistance and being not so high in blackness degree. As a result, it has been found that by adding a particular oligomer component to the coating film-forming resin composition, a resin film having high corrosion resistance may be formed even though the amount of the black pigment added is increased, and the resin film may be provided by only one time operation of a dipping treatment and a baking treatment, and thus the invention has been completed.

The invention relates to a black coating film-forming vehicle component and/or fastening component, that is obtained by: treating a surface of a zinc plated metal substrate with a black chemical conversion treatment agent containing trivalent chromium as an active ingredient, to form a black chemical conversion treatment film having an L value (brightness) of from 33 to 30; coating a black coating composition containing a black pigment in an amount of from 25 to 65% by weight in a coating film-forming component and an alkoxysilane oligomer, on the black chemical conversion treatment film; and heat-curing the black coating composition thus coated.

The invention also relates to a manufacturing method for a black coating film-forming vehicle component and/or fastening component, containing: treating a surface of a zinc plated metal substrate with a black chemical conversion treatment agent containing trivalent chromium as an active ingredient, to form a black chemical conversion treatment film having an L value (brightness) of from 33 to 30; coating a black coating composition containing a black pigment in an amount of from 25 to 65% by weight in a coating film-forming component and an alkoxysilane oligomer, on the black chemical conversion treatment film; and heat-curing the black coating composition thus coated.

Advantageous Effects of Invention

According to the invention, a black coating film-forming vehicle component and/or fastening component that has both corrosion resistance and a dark black appearance can be obtained in a simple process including a top coating forming step of coating a black coating composition only once.

Accordingly, the invention can be effectively used as a manufacturing method of a black coating film-forming vehicle component and/or fastening component that can be easily managed and has high economic efficiency.

DESCRIPTION OF EMBODIMENTS

In the invention, a surface of a zinc plated metal substrate is treated with a black chemical conversion treatment agent (which may be hereinafter referred to as a trivalent black chromate solution) containing trivalent chromium as an active ingredient, and then treated with a black coating composition (which may be hereinafter referred to as a top coating composition) containing a black pigment in an amount of from 25 to 65% by weight in the coating film-forming component and an alkoxysilane oligomer, thereby forming a black coating film that has both corrosion resistance and a dark black appearance (L value (brightness) of 28 or less).

Accordingly, the black coating film-forming vehicle component and/or fastening component obtained in the invention contains a zinc plated metal substrate having formed thereon a black chemical conversion treatment film having an L value (brightness) of from 33 to 30 formed with a trivalent black chromate solution, and a black top coating layer having an L value of 28 or less as the final appearance.

In the vehicle component and/or fastening component as a target of the invention, examples of the vehicle component include components of a two-wheel vehicle, such as a motorcycle and a motor scooter, and an ATV (four-wheel buggy), and examples of the fastening component include a bolt, a screw, a nut and a washer.

In practice of the invention, a metal substrate for the vehicle component and/or fastening component as a target of the invention (which may be hereinafter referred to as a target component) is zinc plated according to an ordinary method. The zinc plating is not particularly limited, as far as it can be subjected to a chemical conversion treatment with a trivalent chromate solution, and examples thereof used include an acidic zinc plating bath, a zincate bath and a zinc cyanide plating bath. The plating thickness is also not particularly limited, as far as the subsequent chemical conversion treatment with a trivalent chromate solution can be performed.

The target component thus zinc plated is then treated with a trivalent black chromate solution to form a chemical conversion treatment film. The trivalent black chromate solution used may be a known one that does not contain hexavalent chromium, and is necessarily one that is capable of forming, after the treatment therewith, a black chemical conversion treatment film having an L value (brightness) of approximately from 33 to 30. This is because the black chemical conversion treatment film obtained with a trivalent black chromate solution treatment has deeper black color with an increased sulfur content, but has deteriorated corrosion resistance with an increased sulfur content, and if the L value is made 30 or less, deterioration of the corrosion resistance may occur due to the too large sulfur content and may not be recovered by the subsequent treatment with a top coating composition. The L value for brightness herein is a value that is measured with a spectrophotometric colorimeter (CM-700d, produced by Konica Minolta, Inc.).

The content of $Cr^{3+}$ in the black chemical conversion treatment film is preferably in a range of from 0.05 to 0.2 $mg/dm^2$.

The formulation of the trivalent chromate solution has been known, and the trivalent chromate solution is commercially available. Examples of the commercially available product thereof include Trivalent 1100, available from JCU Corporation.

The target component, which has been subjected to the black chemical conversion treatment to provide an L value (brightness) of approximately from 30 to 33 as described above, is finally coated with a top coating composition, which is then heated and cured to provide a top coating layer. Examples of the coating method used include known methods, such as dip coating, spray coating and brush coating, and dip coating is preferred from the standpoint of workability.

The top coating composition contains a thermosetting film forming component (which may be hereinafter referred to as a film forming component) that contains a thermosetting component, such as an ordinary thermosetting binder component, and the film forming component further contains a black pigment and an alkoxysilane oligomer.

Examples of the thermoplastic binder component include the combination of a hydroxyl group-containing coating film-forming resin and an amino resin crosslinking agent described in PTL 1. Examples of the hydroxyl group-containing coating film-forming resin include a hydroxyl group-containing polyester resin, a hydroxyl group-containing acrylic resin, a hydroxyl group-containing silicone-modified polyester resin, a hydroxyl group-containing silicone-modified acrylic resin and a hydroxyl group-containing fluorine resin. Examples of the amino resin crosslinking agent include a methylolated amino resin obtained through reaction of an amino component, such as melamine, urea, benzoguanamine, acetoguanamine, spiroguanamine and dicyandiamide, with an aldehyde.

The top coating composition contains a black pigment in such an amount that is capable of providing sufficient blackness with one time operation, i.e., in an amount of from 25 to 65% by weight, and preferably from 30 to 50% by weight, in the component that finally forms the film. Preferred examples of the black pigment include carbon black. The carbon black is not particularly limited, and those of various manufacturing methods and various particle diameters may be used.

Examples of the alkoxysilane oligomer (an organosilicate condensate) contained in the top coating composition include an alkoxysilane oligomer comprising a unit represented by the following formula (1):

$$(R^1)_n\text{—Si—}(OR^2)_{4-n} \quad (1)$$

wherein $R^1$ represents an alkyl group having from 1 to 18 carbon atoms, which may be substituted by a mercapto group, or a phenyl group, which may be substituted by a mercapto group; $R^2$ represents an alkyl group having from 1 to 6 carbon atoms; and n represents a number of 0 or 1.

The alkoxysilane oligomer (which may be hereinafter referred simply to as an oligomer) is described in PTL 1, and examples thereof include a condensate having a condensation degree of approximately from 2 to 20 formed of a combination of one or more kinds of a tetrafunctional silane, such as tetramethylmethoxysilane, tetraethylmethoxysilane, tetramethylethoxysilane, tetraethylethoxysialne, tetrapropylmethoxysilane, propylethoxysialne and tetraphenylmethoxysilane, and a condensate having a condensation degree of approximately from 2 to 20 formed of a combination of one or more kinds of a trifunctional silane having a mercapto group, such as mercaptomethyltrimethoxysilane, mercaptoethyltrimethoxysilane, mercaptomethyltriethoxysilane, mercaptoethyltriethoxysilane, mercaptopropyltrimethoxysilane and mercaptopropyltriethoxysilane.

These oligomers are commercially available under the trade names including KC-89S, KR-500, X-409250, X-409225 and X-409246, and the trade names including X-41-1818 and X-41-1810, all produced by Shin-Etsu Chemical Co., Ltd., which may be used in the invention.

Among these, the oligomer that has a mercapto group is preferred from the standpoint of the final capability of the top coating. The amount of the oligomer added is preferably approximately 40 to 65% (in terms of solid content).

The ratio of the black pigment and the oligomer (in terms of solid content) in the top coating composition is preferably from ⅓to ⅔.

The top coating composition may further contain a friction coefficient controlling agent, in addition to the aforementioned essential components. The friction coefficient controlling agent is preferably polyolefin solid wax, and more preferably one selected from a group including polyethylene, polypropylene and amide wax, one or more kinds of which may be used. In the case where the friction coefficient controlling agent is used, the amount thereof used is preferably from 5 to 20% by weight in the film-forming component.

The top coating composition used in the invention may be produced by sufficiently agitating and mixing the thermosetting binder component, the black pigment and the oligomer, and the friction coefficient controlling agent if any, and further depending on necessity, a known organic solvent, such as isopropyl alcohol and butyl cellosolve (BCS), according to an ordinary method, so as to disperse the components uniformly.

The treatment of the vehicle component and/or fastening component having been subjected to the black chemical conversion treatment, with the top coating composition thus prepared is performed by coating the top coating composition on the component or dipping the component in the top coating composition, and then heating and curing the top coating composition by an ordinary method.

The heating is preferably performed at a temperature of approximately from 100 to 250° C. for approximately from 10 to 60 minutes, and thereby a black top coating is formed.

The feature of the top coating-forming treatment with the top coating composition of the invention is that a favorable top coating layer can be formed by one time treatment (once coating) on the vehicle component and/or fastening component having been subjected to the black chemical conversion treatment as a target. Specifically, the composition contains a large amount of the black pigment, such as carbon black, and also contains the oligomer, as described above, and thus a film having dark black color (L value of 28 or less) having a thickness of approximately from 0.3 to 3 μm after drying can be formed by once dipping. The feature provides a great advantage since the production operation is reduced in time and made easy, and can be adapted to an automated process.

EXAMPLE

The invention will be described in more detail below with reference to examples, but the invention is not limited to the examples.

Example 1

An iron material having a rectangular shape (60 mm×100 mm×5 mm) was zinc plated with the following composition under the following condition.

Zinc Plating Solution Composition

The zinc plating bath used was a zincate bath formed by dissolving zinc in an amount providing 14 g/L in a sodium hydroxide aqueous solution in an amount providing 140 g/L. An additive for dimension process, available from JCU Corporation, was used as an additive in the designated amount.

Zinc plating Condition

Bath temperature: 28° C.

Zinc plating time: 30 minutes

Current density: 3 A/dm$^2$

The iron material having been zinc plated was then treated with a black chromate solution containing trivalent chromium as an active ingredient under the following two conditions, so as to form a chemical conversion treatment film. The L value (brightness) of the black chromate treated product having the chemical conversion treatment film was in a range of from 30 to 33 for the chemical conversion treated product A treated under the treatment condition A and in a range of from 26 to 28 for the chemical conversion treated product B treated under the treatment condition B. The appearance thereof visually observed was dark green for the chemical conversion treated product A and black for the chemical conversion treated product B.

Treatment Condition A

Treating Solution:

| | |
|---|---|
| Trivalent 1100AM ($Cr^{3+}$ base) | 100 mL/L |
| Trivalent 1100BM (containing S compound) | 5 mL/L |

pH: 2.1

Temperature: 25 to 40° C.

Treating time: 30 seconds

Treatment Condition B

Treating Solution:

| | |
|---|---|
| Trivalent 1100AM ($Cr^{3+}$ base) | 100 mL/L |
| Trivalent 1100BM (containing S compound) | 30 mL/L |

pH: 2.1

Temperature: 25 to 40° C.

Treating time: 30 seconds

The chemical conversion treated product A among the products having been subjected to the black chromate treatment was dipped in the four kinds of the top coating compositions (the top coating compositions 1 to 4) shown in Table 1 below at room temperature for 10 seconds. Thereafter, the excessive composition was drained off by centrifugal drying at room temperature, and the product was heated and baked under the following condition, thereby forming a top coating film. The L values (brightness) after the top coating treatment with the top coating compositions each were from 26 to 28, which was black under visual observation. The total amount of the oligomer component (in terms of amount of $SiO_2$) and the carbon black in the final top coating film was 63% for the top coating composition 1, 71% for the top coating composition 2, 65% for the top coating composition 3, and 81% for the top coating composition 4.

Formulations of Top Coating Compositions

TABLE 1

| Top coating composition | Oligomer Kind | Oligomer Amount | Amount of carbon black | Amount of urethane resin[1] | Amount of PVP |
|---|---|---|---|---|---|
| 1 | X-41-1810[2] | 50 g | 30 g | 120 g | 15 g |
| 2 | X-41-1810[2] | 75 g | 50 g | 80 g | 30 g |
| 3 | KC-89C[3] | 75 g | 30 g | 75 g | 20 g |
| 4 | KR-500[4] | 100 g | 60 g | 50 g | 20 g |

Note:
[1]HUX-522 (produced by ADEKA Corporation, solid content: 27%)
[2]Product of Shin-Etsu Chemical Co., Ltd. (amount of oligomer: 53% by weight in terms of $SiO_2$)
[3]Product of Shin-Etsu Chemical Co., Ltd. (amount of oligomer: 59% by weight in terms of $SiO_2$)
[4]Product of Shin-Etsu Chemical Co., Ltd. (amount of oligomer: 63% by weight in terms of $SiO_2$)

Heating and Baking Condition
Temperature: 180° C.
Baking time: 40 minutes

Example 2

The products of the invention (the products A-1 to A-4) having been subjected to the zinc plating, the black chromate treatment under the treatment condition A, and the treatment with one of the top coating compositions 1 to 4 in Example 1 were measured for corrosion resistance by the salt spray test (JIS 22371) and evaluated under the following standard. The results are shown in Table 2 below.

Evaluation Standard
Evaluation: Evaluation content
AA: no white rust formed after salt spray test for 480 hours
A: white rust formed in area of from 1 to 5% after salt spray test for 480 hours
B: white rust formed in area of from 5 to 10% after salt spray test for 480 hours
C: white rust formed in area of 80% or more after salt spray test for 480 hours (red rust formed)

TABLE 2

| Product of invention | Evaluation of corrosion resistance |
|---|---|
| Product A-1 | AA |
| Product A-2 | A |
| Product A-3 | A |
| Product A-4 | A |

The results showed that the product A-1 using the top coating composition 1 exhibited the highest corrosion resistance, and the products A-2 to A-4 using the top coating compositions 2 to 4 exhibited sufficient corrosion resistance.

The product having been subjected to the zinc plating and the black chromate treatment under the treatment condition B in Example 1 (comparative product) formed some white rust (formed area of 5 to 10%) after 168 hours, significant white rust (formed area of 10 to 50%) after 480 hours, and red rust after 720 hours, and thus was inferior in corrosion resistance as compared to the products of the invention.

INDUSTRIAL APPLICABILITY

According to the invention, a black coating film-forming vehicle component and/or fastening component that is excellent in appearance and corrosion resistance can be obtained in a simple process. Therefore, the invention can be widely applied to the production of a vehicle component and/or fastening component, which is required to have a good appearance while it is a general-purpose article.

The invention claimed is:

1. A black coating film-forming vehicle component and/or fastening component, that is obtained by: treating a surface of a zinc plated metal substrate with a black chemical conversion treatment agent containing trivalent chromium as an active ingredient, to form a black chemical conversion treatment film having an L value (brightness) of from 33 to 30; coating a black coating composition containing a black pigment in an amount of from 25 to 65% by weight in a thermosetting film-forming component and an alkoxysilane oligomer, on the black chemical conversion treatment film; and heat-curing the black coating composition thus coated.

2. The black coating film-forming vehicle component and/or fastening component according to claim 1, wherein the alkoxysilane oligomer in the black coating composition is a condensation product of an organopolysiloxane comprising a unit represented by the following formula (1):

$$(R^1)_n—Si—(OR^2)_{4-n} \quad (1):$$

wherein $R^1$ represents an alkyl group having from 1 to 18 carbon atoms, which may be substituted by a mercapto group, or a phenyl group, which may be substituted by a mercapto group; $R^2$ represents an alkyl group having from 1 to 6 carbon atoms; and n represents a number of 0 or 1.

3. The black coating film-forming vehicle component and/or fastening component according to claim 1, wherein the ratio of the black pigment and the alkoxysilane oligomer (in terms of solid content) contained in the black coating composition is from ⅓ to ⅔.

4. The black coating film-forming vehicle component and/or fastening component according to claim 1, wherein the black pigment contained in the black coating composition is carbon black.

5. The black coating film-forming vehicle component and/or fastening component according to claim 1, wherein the black coating composition further contains a friction coefficient controlling agent.

6. The black coating film-forming vehicle component and/or fastening component according to claim 5, wherein the amount of the friction coefficient controlling agent in the black coating composition is from 5 to 20% by weight in the thermosetting film-forming component.

7. The black coating film-forming vehicle component and/or fastening component according to claim 5, wherein the friction coefficient controlling agent is a polyolefin solid wax.

8. The black coating film-forming vehicle component and/or fastening component according to claim 7, wherein the polyolefin solid wax is one or more kinds selected from the group consisting of polyethylene, polypropylene and amide wax.

9. The black coating film-forming vehicle component and/or fastening component according to claim 1, wherein the coated film of the black coating composition has a thickness of from 0.3 to 3 μm.

10. The black coating film-forming vehicle component and/or fastening component according to claim 1, wherein the content of $Cr^{3+}$in the black chemical conversion treatment film is in a range of from 0.05 to 0.2 mg/dm$^2$.

11. The black coating film-forming vehicle component and/or fastening component according to claim 1, which has an L value as a brightness of the exterior blackness degree of 28 or less.

12. The black coating film-forming vehicle component and/or fastening component according to claim 1, which is a bolt, a screw, a nut or a washer.

13. A manufacturing method for a black coating film-forming vehicle component and/or fastening component, comprising: treating a surface of a zinc plated metal substrate with a black chemical conversion treatment agent containing trivalent chromium as an active ingredient, to form a black chemical conversion treatment film having an L value as brightness of from 33 to 30; coating a black coating composition containing a black pigment in an amount of from 25 to 65% by weight in a thermosetting film-forming component and an alkoxysilane oligomer, on the black chemical conversion treatment film; and heat-curing the black coating composition thus coated.

* * * * *